United States Patent [19]

Kawanishi

[11] Patent Number: 4,835,004

[45] Date of Patent: May 30, 1989

[54] METHOD AND APPARATUS FOR APPLYING A COATING LIQUID TO A MOVING WEB

[75] Inventor: Naoyuki Kawanishi, Kanagawa, Japan

[73] Assignee: Fuji Photo Film Co., Ltd., Kanagawa, Japan

[21] Appl. No.: 220,274

[22] Filed: Jul. 18, 1988

[30] Foreign Application Priority Data

Jul. 17, 1987 [JP] Japan ..... 62-177299

[51] Int. Cl.[4] ..... B05D 3/14; B05D 1/26; B05B 5/02

[52] U.S. Cl. ..... 427/13; 118/624; 118/638; 427/316; 430/127; 430/935

[58] Field of Search ..... 427/13, 316, 26; 118/624, 638; 430/127, 935

[56] References Cited

U.S. PATENT DOCUMENTS 2,952,559 9/1960 Nadeau ..... 118/638 X
3,462,286 8/1969 Geest et al. ..... 427/13
4,513,683 4/1985 Kisler ..... 118/638 X
4,517,143 5/1985 Kisler ..... 427/13 X

FOREIGN PATENT DOCUMENTS 2724975 11/1978 Fed. Rep. of Germany ..... 427/316

*Primary Examiner*—Evan Lawrence
*Attorney, Agent, or Firm*—Sughrue, Mion, Zinn, Macpeak and Seas

[57] ABSTRACT

The invention relates to a method and apparatus for treating a moving web prior to the applying of a photosensitive coating liquid. In order to suppress the entrapment of air between the coating layer and the web, the surface of the web is electrostatically charged so that the coating liquid will be attracted to the web. Wide variations of the potential distribution across the web are avoided by subjecting the web to heat while simultaneously bleeding off part of the surface potential. The heating step increases the mobility of electrostatic charge and accelerates the charge redistribution across the web. The web is subsequently cooled to a temperature between 5° and 25° C. in order to preserve the surface potential of the web until the web is coated.

10 Claims, 2 Drawing Sheets

METHOD AND APPARATUS FOR APPLYING A COATING LIQUID TO A MOVING WEB

BACKGROUND OF THE INVENTION

The present invention relates to a method and an apparatus for applying a coating liquid to a moving web or film, and particularly relates to a method of coating a high speed moving web with a thin layer of photosensitive material.

Conventionally, photosensitive materials have been applied to moving web according to a method wherein a backing roller in contact with the web is impressed with a DC voltage. Such discharge processing methods have the advantage of increasing the adhesive force between the web and the coating layer, and also reduce the problem of nonuniform liquid application due to air entrapment between the web and the coating liquid. Such a method is disclosed in British Pat. No. 1,130,109. In other methods, a direct current is applied during pre-processing steps at the liquid application section. Such arrangements are disclosed in Japanese unexamined patent application publications Nos. 55-142565 (1980), 61-146369 (1986) and 61-14670 (1986).

However, the aforementioned DC voltage application methods have serious disadvantages. In these methods, air entrapment between the web and the coating liquid caused by the enfolding of air between the web and the coating liquid is suppressed by strengthening the adhesion between the coating liquid and the web by adding an electrostatic attraction force in addition to the ordinary intermolecular force acting therebetween. However, it is rather difficult to apply a uniform electrostatic attractive force over the entire width of the web when the width dimension of the web is large. In such cases, the nonuniformity of the applied electrostatic force causes the appearance of streaks in the finished web after it has been coated with the photosensitive material. Such streak defects render the resultant product unusable. Especially with web widths ranging up to 1 meter or more, this problem is particularly significant.

In methods where the web surface is charged by means of corona discharging preceding the coating process, the discharge process cannot be uniformly performed. Particularly, an unevenness in the charge distribution is generated because it it not possible to maintain a uniform distance between the electrode and the opposing surface of the web because of the roughness of the web surface. There may also be some unevenness in the chemical composition of the web, leading to the same result.

In methods wherein a DC voltage is applied via a backing roller, unevenness in the charge distribution at the surface of the web is caused due to variations in the thickness of the web and the uneven dielectric distribution in the web.

SUMMARY OF THE INVENTION

In view of the foregoing problems present in the prior art, it is an object of the present invention to provide a method whereby charge nonuniformity is eliminated, to thereby eliminate nonuniformities in coating in the subsequent coating process. This object is achieved by a coating method wherein static electricity is applied to the web surface via corona discharge or the application of a DC voltage, prior to the coating process, wherein, according to the invention, part of the electrostatic charge is subsequently bled to ground while heating the web such that the temperature thereof reaches 30° to 100° C. between the time of static electricity application and the time in which the web is coated, and wherein the temperature of the web is thereafter cooled to a temperature of 5° to 25° C. before being fed to the coating location.

According to the invention, the DC voltage is applied via an electrode connected to a high voltage supply (1 to 20 kv). The electrode may be in the form of a brush, blade, wire, etc. The electrode may also be disposed in the heating zone as described hereunder.

For heating the web to the 30° to 100° C. temperature, a heating zone is provided prior to the coating section. Any kind of heating methods can be employed, such as infrared heating, hot blast heating, microwave heating, or heat transmission via a heating roll or rolls.

In order to partially bleed off part of the static charge while heating, a static eliminator in the form of a roller, brush, conductive surface, etc. is electrically connected to ground and disposed within the heating zone.

For cooling the web subsequent to the heating step, a cooling zone is provided and cooling is carried out either via cold blast cooling, cooling rolls, or the like.

DESCRIPTION OF THE PREFERRED EMBODIMENTS

The method of the invention will now be described with reference to the accompanying drawings.

Figure 1:
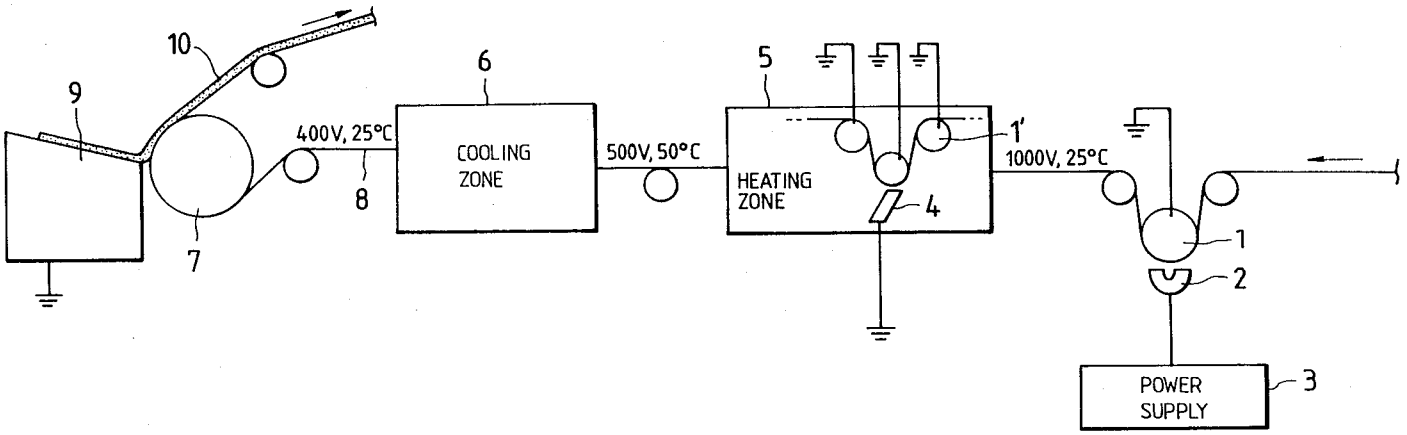
FIG. 1 is a process flow sheet illustrating one embodiment of a coating method provided according to the present invention.

FIG. 1 is a process flow diagram illustrating the overall method. In FIG. 1, a triacetate cellulose base 8 used as a web moves from right to left in the drawing. The web is first charged to a voltage of 1000 volts by a power supply 3 via an electrode 2 which opposes a grounded roller 1 via the web. Subsequently, the web is heated by a hot blast method in a heating zone which accommodates a web length of 20 meters. The hot blast is at a temperature between 30° and 170° C., and the web reaches a temperature between 30° and 150° C., preferably 50° and 100° C., within the heating zone.

Figure 2:
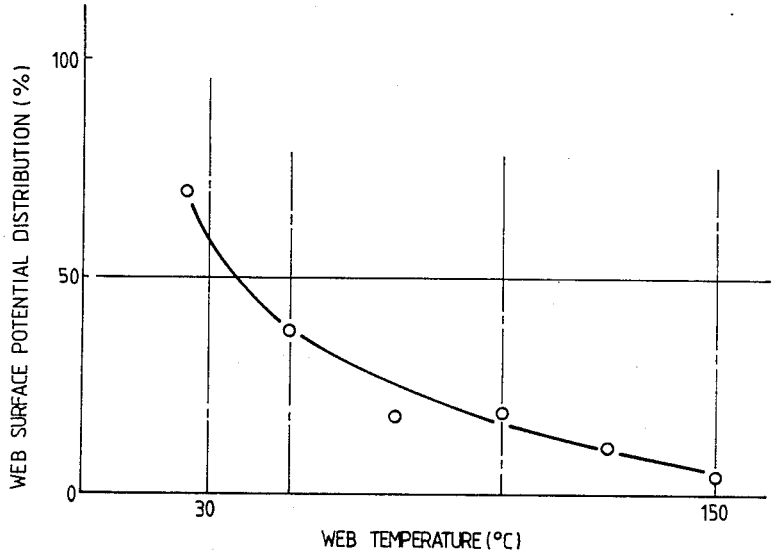
FIG. 2 is a chart showing the relationship between the web temperature and the web surface potential distribution.

FIG. 2 illustrates the results of an experiment conducted to show the effect of the web temperature upon the potential distribution at the web surface. In the figure, the ordinate axis represents the ratio of the difference between the highest and lowest peaks of the surface potential with respect to the average value of the surface potential. Lower values are therefore indicative of a smaller swing in the surface potential values. From the plot of FIG. 2, it is apparent that the web temperature must be not less than 30° C., and preferably not less than 50° C., because the web surface potential distribution increases rather rapidly at lower temperatures. When the ratio referred to above is greater than 50%, i.e., when the surface potential distribution ratio exceeds 50%, the coating layer is nonuniformly applied. Since the film becomes softened and deformable at temperatures greater than 150° C., it is desirable to set the upper temperature limit at this level, or preferably at 100° C. The preferable range between 50° and 100° C. is marked in FIG. 2. It will be apparent from the figure that, within this range, the heating process causes a general smoothing of the potential distribution, without risking heat damage to the web. The smoothing function is attributable to an increase in the mobility of the electrostatic charge which accompanies heating. In particular, the heating step permits redistribution of the charge to proceed more quickly.

In the heating zone, 10 grounded rollers 1' of 100 millimeter diameter are arranged in the transport path and a static eliminator 4 is arranged in opposition to the web. The web is grounded by the rollers 1' and the static eliminator 4, such that the voltage potential level of the web leaving the heating zone is regulated to about 500 volts. The temperature of the web is about 50° C. at the exit of the heating zone.

Figure 3:
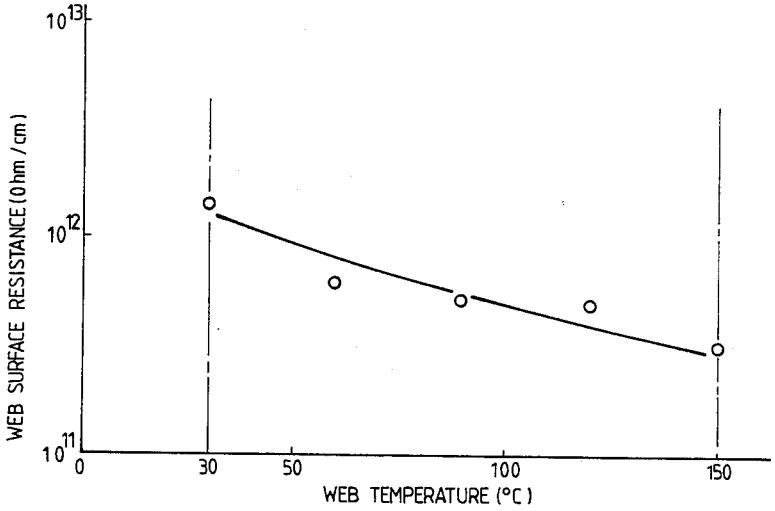
FIG. 3 is a chart showing the relationship between the web temperature and the web surface resistance.

The web next passes through a cooling zone 6 which accommodates a web length of about 20 m. Within the cooling zone, the web is cooled via a cool blast method to a temperature between 5° and 15° C. As shown in FIG. 3, as the web temperature rises, the mobility of electrostatic charge in the web increases, which induces charge leakage. The charge also naturally decreases with the passage of time. If the charge is decreased to a substantial degree, it is then impossible to obtain the degree of charge required at the coating application station. In order to prevent this problem, it is desirable to lower the temperature of the web to the upmost degree. From a practical standpoint, it has been found that a range of 20° to 30° C. is appropriate from an energy/cost point of view. As shown in FIG. 3, by lowering the web temperature to the neighborhood of 30° C., the mobility of electrostatic charge can be reduced several times as compared to that at higher temperatures. Thus, the cooling process serves as a charge preservation means.

After cooling, the web is transported to back-up roller 7 which faces the coating head 9. By the time the web exits the cooling zone, it has reached a temperature in the neighborhood of 25° C. and the surface voltage potential has decreased to approximately 400 volts. Under these conditions, when the coating liquid 10 is applied to the substrate 8 at the coating head 9 at a speed of 100 m/min, no coating nonuniformities are produced, whereby good surface quality is obtainable.

According to the invention, in a method wherein static electricity is applied to the surface of a web by DC voltage application or corona discharge, the web is heated to reach a temperature between 30° and 100° C., whereby the mobility of electrostatic charge may be increased to assist in uniformly distributing the charge on the web surface. Subsequently, the coating liquid is applied to the moving web prior to substantial charge dissipation.

Nonuniformity of the charge disposed on the web is suppressed by bleeding off a part of the charge to ground. The subsequent leakage of charge is prevented by cooling the web to 20° to 30° C., so that the charge on the web may be preserved at an appropriate level until coating takes place. In this manner, the force of adhesion and the attaching force between the web and the coating liquid, which are required for high speed thin layer application, are maintained, and coating nonuniformities are not produced.

The present invention will be further illustrated by way of the following example.

A series of experiments were carried out under the following conditions:

| | | |
|---|---|---|
| Web Material: | Triacetate cellulose film | |
| Coating liquid: | Gelatin: | 100 parts by weight |
| | Sodium Dodecyl Sulphate, 5% solution: | 30 parts by weight |
| | Water: | 800 parts by weight |

The remaining components of the coating liquid were dissolved in the water and a regulated amount of liquid was supplied to the coating head. Application of the coating liquid was performed at a speed of 100 m/min. Several runs were performed for cases where the electrode potentials were set to respective levels within the range of 0 to 5 kv. In all cases, coating was performed with the surface potential adjusted to 500 volts, with the heating zone blast temperature between 25° and 80° C. and the cooling zone blast temperature between 10° and 25° C. The finished products were examined for coating nonuniformities due to both enfolded or entrapped air and insufficiency or nonuniformity of the electrostatic charge. The results are compiles in Table 1, following.

TABLE 1

| Experiment No. | Electrode potential | Heating zone blast temperature | Cooling zone blast temperature | Heating zone substrate temperature | Potential at coating section | Entrapped air | Nonuniformity of application due to electric charge |
|---|---|---|---|---|---|---|---|
| 1 | 0 KV | 70° C. | 10° C. | 60° C. | 0 V | XX | N/A |
| 2 | 2 KV | 25° C. | 25° C. | 25° C. | 500 V | o | XX |
| 3 | 3.5 KV | 50° C. | 10° C. | 40° C. | 500 V | o | Δ |
| 4 | 4.0 KV | 60° C. | 10° C. | 50° C. | 500 V | o | o |
| 5 | 4.5 KV | 70° C. | 10° C. | 60° C. | 500 V | o | o |
| 6 | 5.0 KV | 80° C. | 10° C. | 70° C. | 500 V | o | o |

XX - phenomenon observed
o - phenomenon not observed
Δ- phenomenon observed slightly In experiment no. 1, entrapped or enfolded air captured between the web and the coating liquid was observed, owing to the lack of any electrostatic attraction between the web and the coating liquid. In all other cases, this phenomenon was not observable.

In experiment no. 2, it is considered that the coating irregularities were due to the nonuniformity of the surface potential. The potential smoothing effect did not occur because of a lack of sufficient heating in the heating zone.

In experiment no. 3, the coating results were generally better, but irregularities due to the nonuniformity of the surface potential were still observed. The removal of charge nonuniformities in the heating zone was insufficient.

Experiments 4, 5 and 6 exhibited satisfactory results, and the end products did not exhibit observable coating irregularities. In each of these experiments, the web temperature in the heating zone reached at least 50° C.

According to the present invention, static electricity is impressed upon the surface of a web and is subsequently made uniform by bleeding off a part of the surface potential while heating the web such that the temperature thereof reaches between 30° and 100° C. The heating process accelerates the charge redistribution and causes a general smoothing of the potential distribution across the web. The surface potential is substantially maintained by subsequently web to cooling, such that the web reaches a temperature between 5° and 25° C. before being fed to the coating section. According to this process, the high speed application of a thin layer of coating liquid is made possible without occurrence of coating irregularities, with the resultant product exhibiting high quality.

I claim:

1. A coating method, comprising;

impressing an electrostatic charge on a surface of a web;

grounding electrically said web while heating said web such that the temperature thereof reaches between 30° and 100° C., to reduce the surface potential of said web and promote the charge redistribution;

thereafter cooling the web to a temperature between 5° and 25° C.; and applying a coating liquid to said web at a coating station.

2. A method as claimed in claim 1, wherein said step of grounding said web while heating said web reduces said surface potential by at least a factor of 2.

3. A method as claimed in claim 2, wherein said surface potential is reduced to approximately 500 volts.

4. A method as claimed in claim 1, wherein said cooling step sufficiently reduces the mobility of the electrostatic charge of said web so as to promote preservation of said surface potential between said heating step and said coating step.

5. An apparatus for processing and coating a web; comprising;

means for impressing a DC voltage upon a surface of said web, heating means for heating said web to a temperature between 30° and 100° C., means for bleeding off a part of the charge located within said heating means, for substantially reducing the surface potential of said web, means for cooling said web to a temperature between 5° and 25° C., and coating means for applying a coating liquid to said web.

6. An apparatus as claimed in claim 5, wherein said voltage applying means comprises a high voltage power supply, an electrode coupled to said power supply and facing a surface of said web to be charged, and a grounded roller contacting a reverse surface of said web.

7. An apparatus as claimed in claim 5, wherein said voltage applying means comprises corona discharge means.

8. An apparatus as claimed in claim 5, wherein said bleeding off means comprises means for contacting said web and connected to ground, for reducing the surface potential of said web by at least a factor of 2.

9. An apparatus as claimed in claim 8, wherein said bleeding off means comprises a series of grounded rollers contacting said web, and static eliminator facing said web surface.

10. An apparatus as claimed in claim 5, wherein said heating means comprises a hot blast heating source.

* * * * *